US005787622A

United States Patent [19]

Green et al.

[11] Patent Number: 5,787,622

[45] Date of Patent: Aug. 4, 1998

[54] SIGNBOARD

[75] Inventors: Frank Green; Susan Jane Speak, both of Middlesex, Great Britain

[73] Assignee: Advanced Engraving Limited, Middlesex, Great Britain

[21] Appl. No.: 640,910

[22] PCT Filed: Sep. 8, 1995

[86] PCT No.: PCT/GB95/02169

§ 371 Date: May 9, 1996

§ 102(e) Date: May 9, 1996

[87] PCT Pub. No.: WO96/08807

PCT Pub. Date: Mar. 21, 1996

[30] Foreign Application Priority Data

| | | | |
|---|---|---|---|
| Sep. 16, 1994 | [GB] | United Kingdom | 9418751 |
| Oct. 27, 1994 | [GB] | United Kingdom | 9421673 |
| Nov. 3, 1994 | [GB] | United Kingdom | 9422207 |

[51] Int. Cl.[6] ..... G09F 7/04

[52] U.S. Cl. ..... 40/621; 40/600; 40/618; 273/157 R

[58] Field of Search ..... 40/600, 611, 621, 40/618, 711, 489; 248/206.5, 467; 446/137; 434/171, 365, 403, 405, 416, 428; 273/156, 157 R

[56] References Cited

U.S. PATENT DOCUMENTS

| | | | |
|---|---|---|---|
| 4,040,194 | 8/1977 | Penton et al. | 40/621 |
| 5,236,166 | 8/1993 | Darling | 40/618 X |
| 5,269,083 | 12/1993 | Vampatella et al. | 40/621 X |

FOREIGN PATENT DOCUMENTS

| | | | |
|---|---|---|---|
| 1547639 | 11/1968 | France | 40/621 |
| 2654858 | 5/1991 | France | 40/600 |
| 8802986 | 4/1988 | Germany . | |
| 3834935 | 4/1990 | Germany . | |
| 768431 | 2/1957 | United Kingdom . | |
| 860332 | 2/1961 | United Kingdom . | |
| 2183885 | 6/1987 | United Kingdom . | |

*Primary Examiner*—Brian K. Green

*Attorney, Agent, or Firm*—Killworth, Gottman, Hagan & Schaeff, L.L.P.

[57] ABSTRACT

A signboard comprises a backboard having a frame which contains a sign member disposed contiguous with the frame so as to fill the area within the frame. The sign member has a rear surface releasably attached to the backboard, for example by means of a magnetic strip, said rear surface also having a recess. The configuration is such that pressure applied to a region of the front surface of the sign member over the area of the recess causes said sign member to lift along its opposite edge sufficiently to facilitate its removal. Alternatively, a plurality of sign members may be provided, disposed contiguous with each other and with the frame, at least one of which sign members is capable of being lifted by applied pressure.

18 Claims, 2 Drawing Sheets

SIGNBOARD

BACKGROUND OF THE INVENTION

This invention relates to a display board or signboard having at least one interchangeable indicia-bearing sign member.

DESCRIPTION OF THE PRIOR ART

In order to prevent tampering with the sign member or members, previous signboards have been constructed with a lockable arrangement in order to prevent unauthorized removal of any sign member and this has necessitated the use of a separate key, without which the sign members cannot be removed. However, having to use a separate key may be inconvenient and the key may be easily lost.

SUMMARY OF THE INVENTION

It is an object of the present invent ion to provide a signboard which alleviates this disadvantage whilst still being resistant to tampering.

From one aspect, the invent ion consists in a signboard comprising a backboard having a frame which contains a sign member disposed contiguous with the frame so as to fill the area within the frame, said sign member having a rear surface releasably attached to said backboard and one of said rear surface or said backboard having a recess or being otherwise configured such that pressure applied to a region of the front surface of the sign member causes said sign member to lift sufficiently to facilitate its removal.

From another aspect, the invention consists in a signboard comprising a backboard having a frame which contains a plurality of sign members for bearing information disposed contiguous with each other and with the frame so as to fill the area within the frame, said sign members each having a rear one of releasably attached to said backboard and at least one of said sign members in conjunction with said backboard defining a recessed area or being otherwise configured such that pressure applied to a region of the front of that sign member causes said sign member to lift sufficiently to facilitate its removal.

Each sign member is preferably releasable attached to the backboard by magnetic force, in which case the rear surface of each sign member may include a permanently magnetic region and the backboard may be ferrometallic. It will of course be understood that the reverse arrangement may be employed.

In one embodiment of the invention, the or each sign member is rectangular and said permanently magnetic region is formed by a magnetic strip occupying a proportion of the width of the or each sign member which can be lifted by applied pressure.

Preferably, the front edges of the or each sign member and the inner front edge of the frame member are chamfered in order to resist any attempt to prise the sign members out of the frame member.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
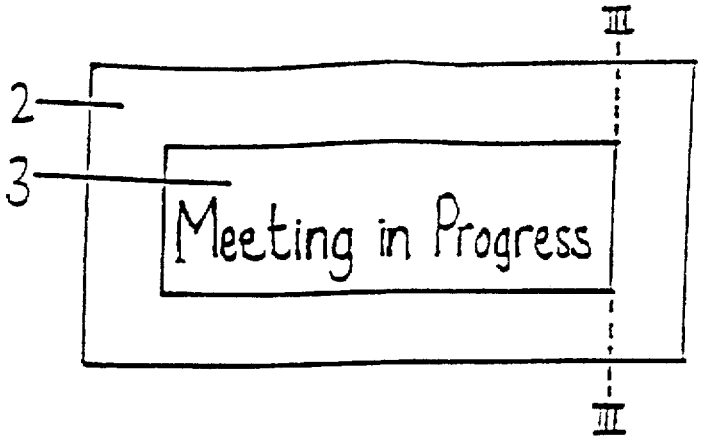
FIG. 1 is a front view of a signboard according to the first aspect of the invention.
Figure 2:
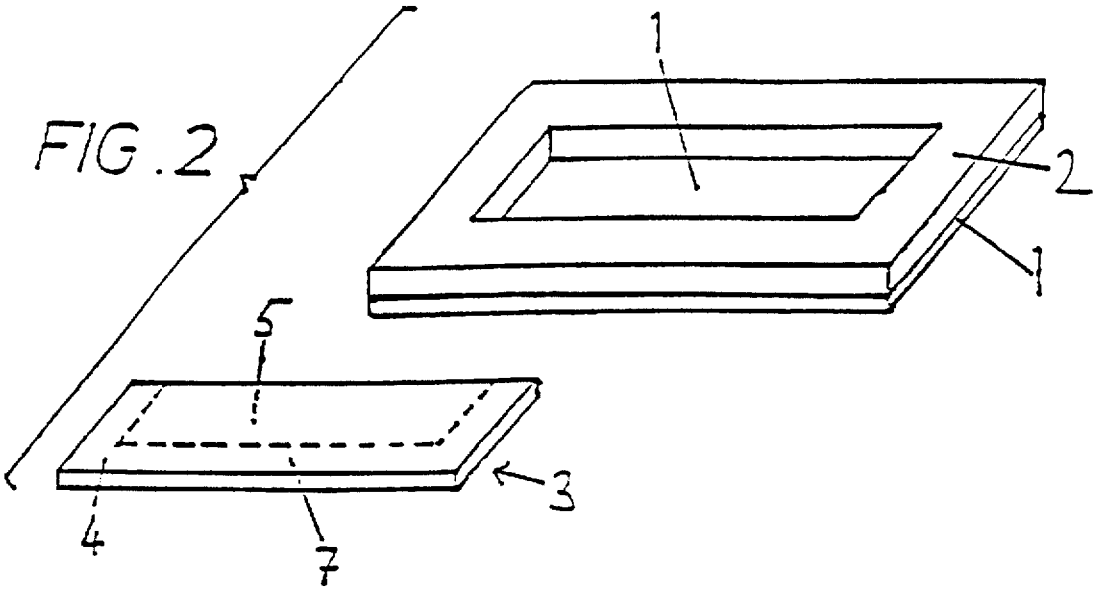
FIG. 2 is a perspective view of the signboard of FIG. 2, showing the sign member removed.
Figure 3:
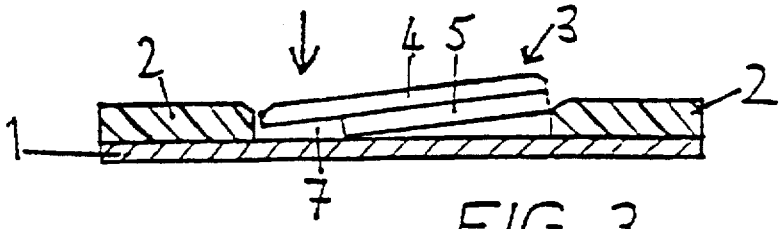
FIG. 3 is a section along the line III—III of FIG. 1, showing the sign member in its partially lifted position.

As shown in FIGS. 1 to 3, according to the first aspect of the invention, the frame encloses only one sign member which fills the area within the frame and has its rear surface configured such that pressure applied to a region of the front surface causes the sign member to lift sufficiently to facilitate its removal.

The signboard includes a rectangular backboard 1 which in this example is made of steel, and a rectangular frame 2 of a plastics material is fixed to one surface of the backboard. A sign member or slat 3 is dimensioned to fit snugly within the frame, thereby completely filling the area within the frame.

As shown in FIG. 2, the slat 3 consists of a strip 4 of a plastic material which carries the indicia on its front surface, and a rear permanent magnetic strip 5, which serves to releasably attach the slat to the steel backboard 1. The slat is chamfered along its entire front edge, and the frame 2 is also chamfered along its inner front edge in order to resist any attempt to pry the slats out of the frame. For clarity, the thickness of the magnetic strips has been somewhat exaggerated in the drawings.

In this embodiment, the slat 3 has a magnetic strip 5 which covers approximately three-quarters of the width of the slat, thereby defining a recess or gap 7 towards one longitudinal edge. As shown in FIG. 3, the slat 3, which is normally held flat on the backboard 1, can be depressed in the area of the recess, as indicated by the arrow, thus causing this slat to pivot and the opposite long edge of the magnetic strip 5 to lift from the backboard 1. After such pivoting, the slat 3 can be removed by its exposed long edge. Since, only an authorized person will know where and in what manner to apply pressure to the slat 3 in order to remote it, the signboard is highly resistant to unauthorized tampering.

Figure 4:
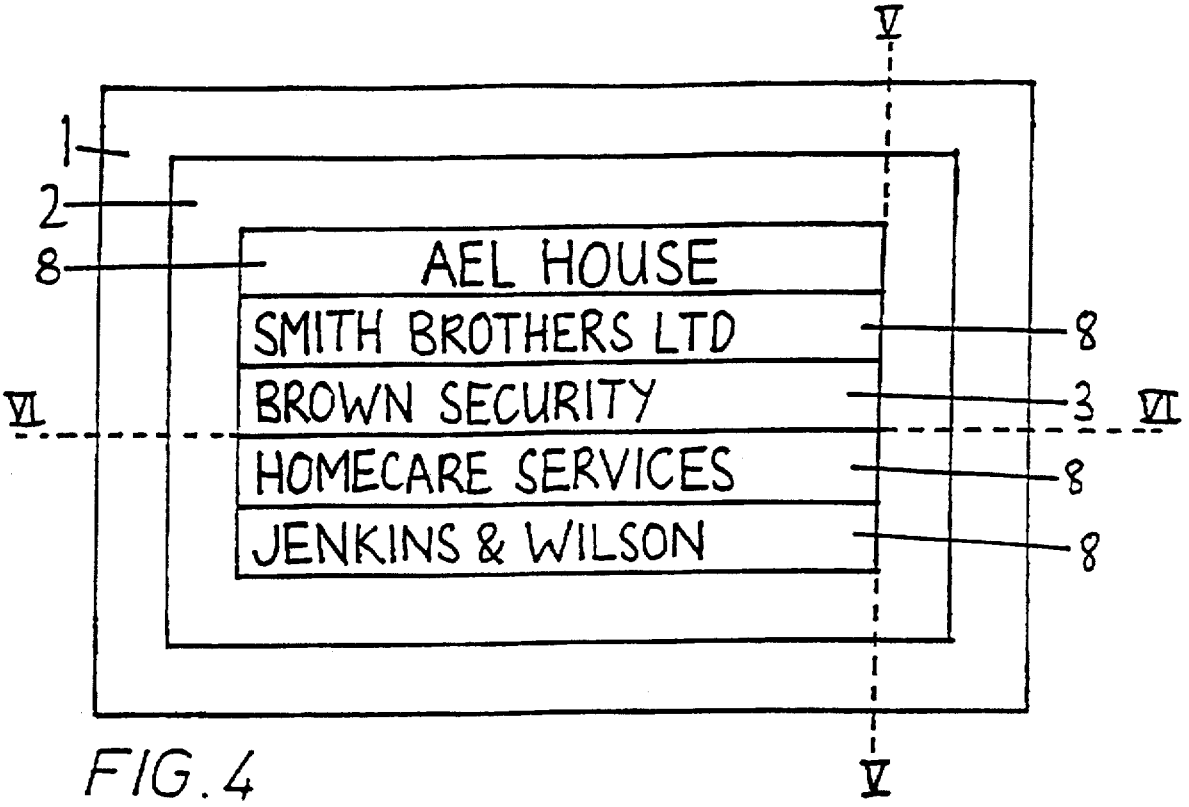
FIG. 4 is a front view of a signboard according to the second aspect of the invention.
Figure 5:
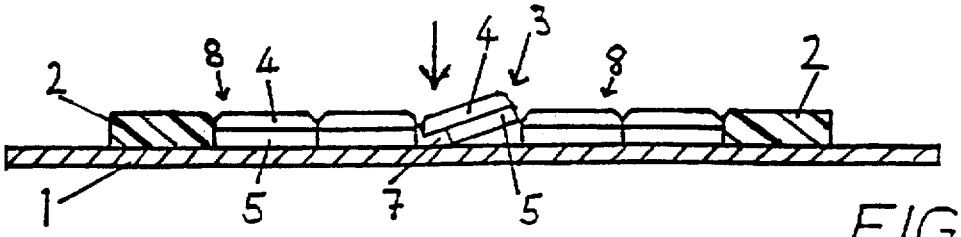
FIG. 5 is a section along the line V—V of FIG. 4, according to a first embodiment and showing one of the sign members in its partially lifted position.
Figure 6:
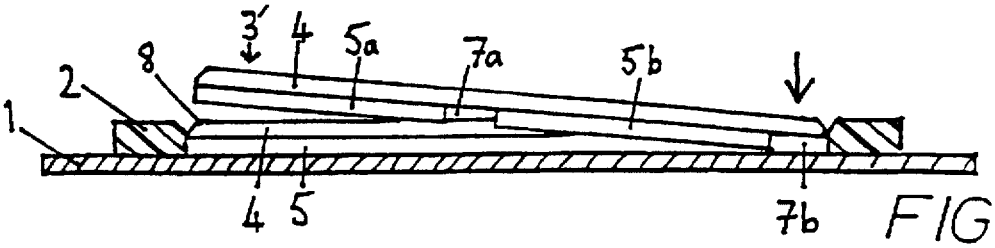
FIG. 6 is a section along the line VI—VI of FIG. 4, according to a second embodiment and showing one of the sign members in its partially lifted position.

FIGS. 4 to 6 show a second aspect of the invention in which the frame 2 contains five slats 3, 8, which fit snugly against each other and the frame. The magnetic strip 5 of each of the slats 8 covers the entire rearmost area of the slat.

Referring now to a first embodiment of the second aspect, as shown in FIGS. 4 and 5, the slat 3 has a magnetic strip portion 5 covering approximately three-quarters of its width, and can therefore be removed in the manner described above with respect to the first aspect.

Once the slat 3 has been removed it will be apparent that any of the slats 8 can be removed, rearranged and replaced as desired. When all the slats 3, 4 are in place within the frame 2, they appear to be constructed identically. The slats 8 cannot be removed without firstly removing the slat 3 and only an authorized person will know which slat to press and where to press it. Clearly the slat 3 which provides the "key" to the removal of any other slat may be positioned anywhere amongst the series of slats and since its position would be known only to an authorized person or persons, the arrangement thereby provides substantial resistance to unauthorized tampering.

FIG. 6 shows a second embodiment of the second aspect of the invention having flexible acrylic front strips 4 and in which a security slat 3' has two magnetic portions 5a, 5b, separated by a gap 7a and also an additional gap 7b at one end.

Normally this slat 3' is held flat on the backboard 1 by the magnetic strip portions 5a, 5b. When it is desired to rearrange or replace any of the slats 3', the slat 3' is pressed at its end in the area of the gap 7b, as shown by the arrow in FIG. 6. This causes the slat to flex or pivot about the adjacent end of the magnetic strip portion 5b, so that the other end of the slat lifts from the backboard, thereby facilitating removal of the slat.

Alternatively to the method of removal illustrated, the slat 3' can be lifted by pressing the intermediate region of the gap 7a, thus flexing the slat and lifting both ends.

Clearly many other arrangements of the magnetic strip portions are possible.

It will be apparent that if desired, all of the plurality of sign members or slats may be so configured on the rear surface that pressure applied to a region of the front of any one of the sign members causes it to lift sufficiently to facilitate its removal.

Whilst particular embodiments have been described, it will be appreciated that modifications may be made thereto without departing from the scope of the invention.

For example, the frame and the indicia-bearing slats or other members need not be rectangular but could be of any other suitable shape.

Figure 7:
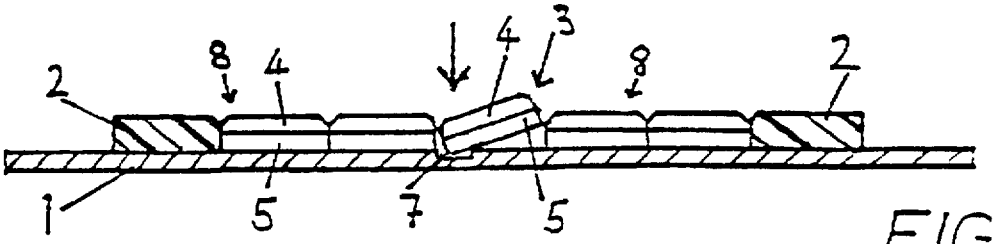
FIG. 7 is a section according to a third embodiment.

While the specific embodiments described incorporate one or more sign members having recesses on their rear surface, the backboard could alternatively be formed with one or more recesses, as shown in FIG. 7. In this alternative construction the magnetic strip portions would preferably be secured to the backboard and the sign members would be ferrometallic.

As an alternative to the use of magnetic materials, the attachment could be provided by "touch-and-close" fasteners or a reusable adhesive.

We claim:

1. A signboard comprising:

a backboard having an area surrounded by a frame;

a plurality of sign members filling said area surrounded by said frame, each of said sign members having a front surface and a rear surface, said rear surface of each of said sign members being releasably attachable to said backboard;

the rear surface of only one sign member of said plurality of sign members being formed with a recess such that pressure applied to a region of said front surface of said one sign member lifts a portion thereof sufficiently to enable removal of said one sign member and thereby removal of remaining ones of said plurality of sign members, the front surfaces of all of said plurality of sign members being constructed such that, apart from different information borne on said sign members, said one sign member is indistinguishable from said remaining ones of said plurality of sign members when said plurality of sign members are attached to said backboard.

2. A signboard as claimed in claim 1, wherein the front surface of each of said plurality of sign members has a periphery which is chamfered and said frame has an inner edge which is chamfered, thereby resisting an attempt to pry said plurality of sign members from said frame.

3. A signboard as claimed in claim 1, wherein each of said plurality of sign members is made of a flexible plastic material.

4. A signboard as claimed in claim 1, wherein a plurality of recessed areas are defined between said one sign member and said backboard.

5. A signboard as claimed in claim 1, wherein said backboard is formed with at least one recess.

6. A signboard as claimed in claim 1, wherein said plurality of sign members are attached to said backboard by magnetic force.

7. A signboard comprising;

a backboard having an area surrounded by a frame;

a plurality of sign members for bearing information disposed contiguous with one another and with said frame so as to fill said area surrounded by said frame;

each of said plurality of sign members having a front surface and a rear surface, said rear surface of each of said plurality of sign members being releasably attachable to said backboard;

the rear surface of only one of said sign members in conjunction with said backboard defining a recessed area such that pressure applied to a region of said front surface of said one sign member causes said one sign member to lift sufficiently to enable said one sign member to be removed from said backboard and thereby enable remaining ones of said plurality of sign members to be removed therefrom;

the front surfaces of all of said sign members being constructed such that, apart from different information bourne on said front surfaces said one sign member is indistinguishable from said remaining ones of said plurality of sign members when said sign members are attached to said backboard, thereby substantially preventing unauthorized removal of said plurality of sign members from said backboard.

8. A signboard as claimed in claim 7, wherein the front surface of each of said plurality of sign members has a periphery which is chamfered and said frame has an inner edge which is chamfered, thereby resisting an attempt to pry said plurality of sign members from said frame.

9. A signboard as claimed in claim 7, wherein each of said plurality of sign members is made of a flexible plastic material.

10. A signboard as claimed in claim 7, wherein a plurality of recessed areas are defined between said one sign member and said backboard.

11. A signboard as claimed in claim 7, wherein said backboard is formed with at least one recess.

12. A signboard as claimed in claim 7, wherein said plurality of sign members are attached to said backboard by magnetic force.

13. A tamper-resistant signboard comprising:

a backboard having an area surrounded by a frame;

a plurality of sign members for bearing information, said sign members being disposed contiguous with one another and said frame so as to fill said area surrounded by said frame, each of said sign members having a front surface and a rear surface, said rear surface of each of said sign members being releasably attached to said backboard;

the rear surface of one of said plurality of sign members in conjunction with said backboard defining a recessed area such that pressure applied to the front surface of said one sign member lifts a portion thereof sufficiently to enable removal of said one sign member from said backboard, and no recessed area being provided between said other ones of said plurality of sign members and said backboard so as to prevent removal of said other ones of said plurality of sign members until said one sign member has been removed;

the front surface of all of said plurality of sign members being constructed such that, apart from said information borne on said sign members, said one sign member cannot be distinguished from said other ones of said plurality of sign members when said plurality of sign members are attached to said backboard, whereby only an authorized person can remove said sign members from said backboard.

14. A signboard as claimed in claim 13, wherein the front surface of each of said plurality of sign members has a periphery which is chamfered and said frame has an inner edge which is chamfered, thereby resisting an attempt to pry said plurality of sign members from said frame.

15. A signboard as claimed in claim 13, wherein each of said plurality of sign members is made of a flexible plastic material.

16. A signboard as claimed in claim 13, wherein a plurality of recessed areas are defined between said one sign member and said backboard.

17. A signboard as claimed in claim 13, wherein said backboard is formed with at least one recess.

18. A signboard as claimed in claim 13, wherein said plurality of sign members are attached to said backboard by magnetic force.

* * * * *

UNITED STATES PATENT AND TRADEMARK OFFICE

CERTIFICATE OF CORRECTION

PATENT NO. : 5,787,622

DATED : August 4, 1998

INVENTOR(S) : Frank Green, Susan Jane Speak

It is certified that error appears in the above-indentified patent and that said Letters Patent is hereby corrected as shown below:

Col. 4, line 15: "signboard comprising;" should read --signboard comprising:--

Col. 4, line 35: "surfaces said one" should read --surfaces, said one--

Signed and Sealed this

Seventeenth Day of November, 1998

Bruce Lehman

*Attest:*

BRUCE LEHMAN

*Attesting Officer*

*Commissioner of Patents and Trademarks*